United States Patent [19]

Stromquist et al.

[11] 4,248,015

[45] Feb. 3, 1981

[54] MULTI-PANE GLAZED DOOR DEFROSTING SYSTEM

[75] Inventors: Michael E. Stromquist, Studio City; James J. Heaney, Glendale, both of Calif.

[73] Assignee: Anthony's Manufacturing Company, Inc., San Fernando, Calif.

[21] Appl. No.: 663,548

[22] Filed: Mar. 3, 1976

[51] Int. Cl.[3] ..... F06B 7/00

[52] U.S. Cl. ..... 49/70; 219/218; 219/522; 219/543; 219/547

[58] Field of Search ..... 49/70; 52/171; 219/218, 219/543, 547, 522

[56] References Cited

U.S. PATENT DOCUMENTS

| | | | |
|---|---|---|---|
| 2,984,718 | 5/1961 | Fish | 49/70 X |
| 3,475,588 | 10/1969 | McMaster | 219/543 X |
| 3,524,920 | 8/1970 | Stromquist et al. | 219/543 X |
| 3,898,423 | 8/1975 | Taylor et al. | 52/171 X |

*Primary Examiner*—Kenneth Downey

*Attorney, Agent, or Firm*—Morganstern, Mann & Smith

[57] ABSTRACT

Apparatus is described for decreasing the frost-free recapture time of a multi-pane glazed door such as is used on refrigerated display cabinets, by selectively heating the innermost pane when it is exposed to high relative humidity conditions. An electric current is passed through an optically transparent electrically conductive layer on the unexposed surface of the innermost pane. This heats the pane to a temperature above the dew point of the ambient air.

5 Claims, 6 Drawing Figures

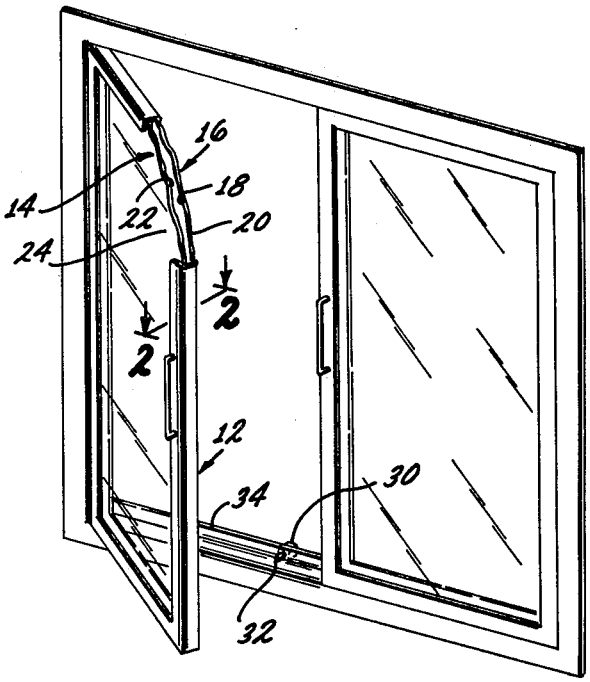
FIG. 1
FIG. 2
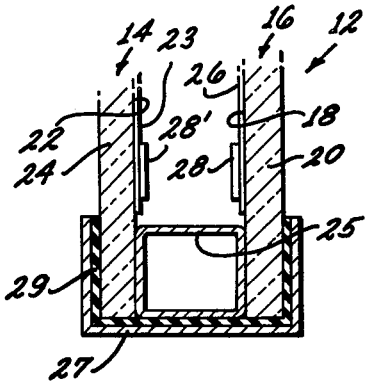
FIG. 3
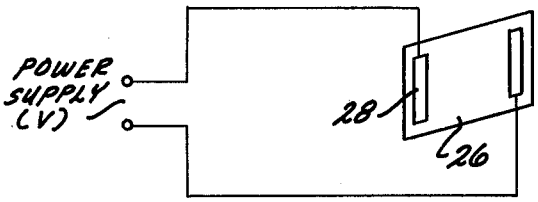
FIG. 4
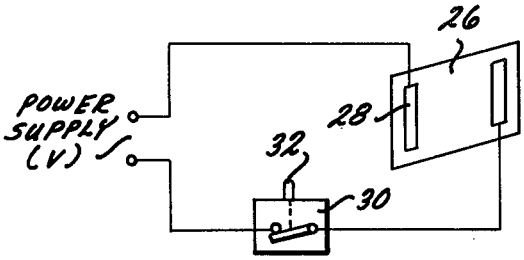
FIG. 5
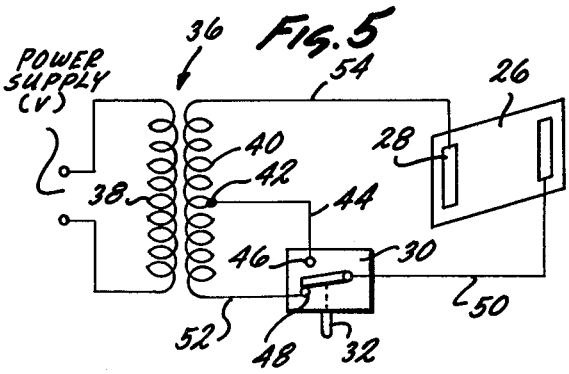
FIG. 6
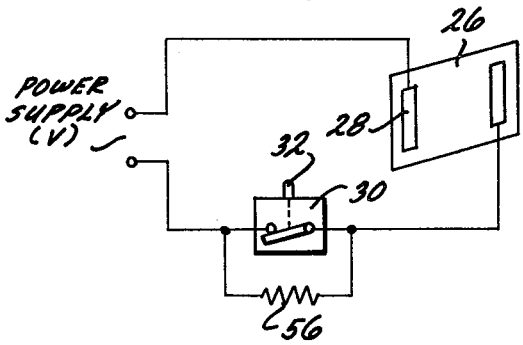

MULTI-PANE GLAZED DOOR DEFROSTING SYSTEM

BACKGROUND OF THE INVENTION

1. Field of the Invention

The present invention relates to refrigerated display cabinets and more particularly, to an electrically heated glazed door structure for use in such cabinets.

2. The Prior Art

In U.S. Pat. No. 3,724,129 to Stromquist, the use of an optically transparent electrically conductive coating for preventing moisture condensation on the frontmost glazed surface of a refrigerated cabinet door is described. Such coatings, normally applied to the unexposed surface of the frontmost glass pane are in current wide use. This heating technique performs well where the ambient air has a relative humidity which is not excessive.

When such refrigerated cabinets are used in highly humid environments, it is found that even though the frontmost pane remains frost-free, the innermost pane (the pane which has been exposed to the interior environment of the cabinet) has a tendency to collect condensation while the door is open. The condensation turns to frost when the refrigerated cabinet door is closed, thereby substantially impairing the door's ability to attractively display products stored in the cabinet until such time as the door recovers its frost free condition.

Consumer shopping habits may further aggravate the situation. It is found that consumers in some areas tend to hold refrigerated cabinet doors open longer than do the consumers in others. This pattern of consumer behavior results in the innermost pane being exposed for a significant percentage of the time to the more highly humid ambient air, thereby aggravating the condensation problem, increasing the frost-free recovery time, and detracting from the utility of closed refrigerated cabinets.

SUMMARY OF THE INVENTION

The present invention is based on the discovery that the frost-free recovery time can be significantly reduced by selectively heating the innermost pane of the door, thus alleviating the problem of frost obscuring the contents of the cabinet. In a preferred embodiment this is accomplished by providing an optically transparent electrically conductive coating on the unexposed surface of the innermost pane for heating the pane when an electric current is applied through the conductive coating. Alternatively, resistive heating wires or other known heating means may be associated with the innermost pane to heat it.

The electric current may be applied continuously, or it may be applied only when the door is opened. In the latter case, the instantaneous power applied would normally be greater than in the former case. In alternative embodiments, both the steady current and the intermittent current may be applied.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a perspective view of an exemplary type of door in which the present invention may advantageously be applied;

FIG. 2 is an enlarged cross-sectional view taken through lines 2—2 of FIG. 1;

FIG. 3 is a circuit diagram for applying a continuous electrical current to the innermost pane;

FIG. 4 is a circuit diagram showing the use of a switch for selectively applying an intermittent electric current to heat the innermost pane;

FIG. 5 is a circuit diagram of a preferred embodiment for applying both a continuous and, selectively, an intermittent current to the innermost pane; and FIG. 6 is a circuit diagram of an alternative embodiment for applying both a continous and, selectively, an intermittent electric current to the innermost pane for heating it.

DESCRIPTION OF THE PREFERRED EMBODIMENT

Referring now to the Figures, there is shown in FIG. 1 a door 12 of a refrigerated cabinet (not shown) with which the present invention is to be used. Such doors normally have more than one pane of glass, to prevent excessive thermal loss. While glass units of more than two panes are not unknown, a two pane unit will be described for purposes of simplicity. Thus, the exemplary door 12 includes an outermost pane 14 and an innermost pane 16.

As shown in FIG. 2, the panes 14 and 16 are held apart by a spacer 25, and are clamped together by the channel-like door frame 27, from which the panes are spaced by a sealing layer 29. Innermost pane 16 has an unexposed surface 18 facing the front of the door and further has an exposed surface 20 which is in contact with the cold air inside the refrigerated cabinet when the door 12 is in its normally closed position.

It is well known in the art to apply an optically transparent electrically conductive coating 23 to the unexposed surface 22 of the frontmost pane 14 to prevent condensation and/or frost from forming on the front surface 24 of frontmost pane 14. For the majority of installations, the exposed surface 20 of the innermost pane 16 does not normally accumulate sufficient condensation or frost to adversely effect the visibility through the door. This is because in normal usage, the door 12 is not open an appreciable percentage of the time. Further, many refrigerated display cabinets are installed in air conditioned stores and hence, are not exposed to conditions of high ambient humidity.

It has been found, however, that in some installations, particularly those located in high humidity environments where shoppers tend to hold the doors in an open position for appreciable times, frost develops on the innermost pane. Such frost significantly detracts from the utility of the doors.

According to the teaching of the present invention, an optically transparent electrically conductive coating 26 is applied to the unexposed surface 18 of the rear pane 16, as shown in FIG. 2. To supply electrical power to the film 26, metallic strip electrodes such as 28 of FIG. 2, are attached to film 26 in electrical contact with it. The strip electrodes 28 are preferably positioned adjacent opposed sides of each film and are connected to a source of electrical power.

FIG. 3 shows the conductive coating 26 connected through metallic strip electrode 28 to a source of electrical power V. This arrangement would be used if it were desired to heat the innermost pane 16 continuously to avoid condensation. This arrangement would be particularly suited for those situations in which the door 12 is open a relatively large percentage of the time.

FIG. 4 shows the use of a switch 30 to control the application of electrical power to the conductive coating 26. Switch 30 may be actuated by a plunger 32 and may preferably be installed in the frame 34 of the door, as shown in FIG. 1. Plunger 32 in FIG. 1 is actuated by contact with the door 12. Switch 30 is of the single-throw type and is normally in an open condition when plunger 32 is depressed by the door in its normally closed position. When the door 12 is opened, the switch 30 is closed permitting current to flow. This embodiment is particularly useful in situations where the door may not be opened frequently but in which the relative humidity is high, so that each time the door is opened, a significant amount of condensation forms on the exposed surface 20 of innermost pane 16.

The embodiments of FIGS. 3 and 4 may be combined effectively in the preferred embodiment shown in FIG. 5. In FIG. 5, a transformer 36 having a primary winding 38 which is connected, for example, to the commercial power line (Source V) has a secondary winding 40 which is tapped at 42. Winding 40 provides both a high voltage and a low voltage source of power.

The high voltage is supplied on conductors 52 and 54 while the low voltage is supplied on conductors 52 and 44. Switch 30, in this embodiment, is of the double-throw type actuated by plunger 32. When the door is closed, plunger 32 is depressed thereby connecting conductor 50 with conductor 44 through terminal 46. In this condition, a low voltage is applied across the conductive coating 26. When the door 12 is opened, plunger 32 activates switch 30 to connect conductor 50 with conductor 52. In this condition, the high voltage on conductors 52 and 54 is applied directly across the conductive coating 26. The embodiment of FIG. 5 is preferred because the only current drawn out of transformer 36 is that used by conductive coating 26.

An alternative embodiment is shown in FIG. 6. In that embodiment, switch 30 is normally in its open position when the door is in its closed position, thereby leaving conductive coating 26 in series with a current-limiting resistor 56. When the door is opened, switch 30 closes shorting out resistor 56 leaving conductor coating 26 connected directly across the power supply. In this embodiment, power is dissipated in the current-limiting resistor 56 as well as in the conductive coating 26, which is wasteful of power unless some use can be found for the heat generated by resistor 56. This heat could, of course, be utilized to good advantage if resistor 56 were, in fact, some other heating element of the system, e.g., a conductive coating on the unexposed surface 22 of frontmost pane 14, or one of the heater wires (not shown) normally used to prevent condensation from forming on the metallic structural portions of the door frame and door mounting frame as is known in the art. The embodiment shown in FIG. 6, like that shown in FIG. 5 permits a normal low voltage continuous power to be applied to conductive coating 26. When the door is opened, a higher level of power is applied to the coating at precisely the time such additional energy is required.

Thus, there has been described an apparatus for preventing moisture from condensing on the exposed surface of the innermost pane of a multipane glazed door used in a refrigerated display cabinet. A conductive coating is applied to the unexposed surface of the innermost pane and a source of electrical power is connected across the coating thereby heating it to a temperature above the dew point of the ambient air.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. In a door adapted to be moveably mounted on a refrigerated cabinet the combination comprising:

an outer transparent panel;

an inner transparent panel having an unexposed surface and a surface exposed to normally refrigerated air within the cabinet in the normally closed position of the door;

mounting means for mounting said outer and said inner transparent panels in spaced relationship; and electrically heating means disposed in heating relationship with said inner transparent panel for selectively heating said inner panel responsive to a selected operative position of the door to prevent the formation of frost thereon, said electrical heating means comprising a resistive-conductive optically transparent coating positioned on the unexposed surface of said inner panel, and further comprising means for selectively applying electrical power to said coating to generate heat therein for heating said inner panel; and wherein said means for selectively applying electrical power has a high level and lower level power output mode, and comprising switch means responsive to the operated position of the door with respect to the cabinet for applying said lower level power to said coating when the door is in a closed position and for applying said high level power to said coating when the door is in an open position.

2. A refrigerated cabinet door adapted to be movably mounted on a refrigerated cabinet comprising:

a first glass pane adapted to be positioned adjacent the ambient environment of the cabinet;

a second glass pane adapted to be positioned adjacent the interior of the refrigerated cabinet;

mounting means for mounting said first and said second panes in aligned, spaced relationship;

a resistive-conductive, transparent coating positioned on the surface of the second pane remote from the refrigerated cabinet interior; and power applying means for selectively applying electrical power to said coating responsive to a selected operative position of the door, whereby electrical energy applied to said coating will result in heating the second pane to prevent the formation of frost thereon;

wherein said power applying means has a high and a low power mode and wherein said power applying means includes switching means responsive to the operated position of the door within the cabinet for connecting said high power to said coating when the door is in an open position and for connecting said low power to said coating when the door is in a closed position.

3. The combination of claim 2 wherein said low power mode comprises said high power mode source in series electrical connection with a dissipative resistive source, said dissipative resistive source being comprised of heater elements disposed in means for mounting the door within the cabinet.

4. In a door adapted to be movably mounted on a refrigerated display cabinet, said door having more than one light conducting pane, including an innermost pane exposed on one surface to colder air inside the cabinet when the door is in its normally closed position, the improvement comprising an electrically conductive, optically transparent coating applied to the unexposed surface of the innermost pane and means operatively connected to said coating for selectively heating the innermost pane responsive to a selective operative position of the door; the improvement further comprising switching means connected electrically to said conductive coating for applying a first level of electrical power to said coating when the door is in a closed position and a second, higher level of electrical power to said coating when the door is in an open position.

5. The improvement of claim 4 wherein said switching means includes a mechanically actuated switch responsive to the position of the door to assume first and second switched positions.

* * * * *